US005356308A

United States Patent [19]

Toba et al.

[11] Patent Number: 5,356,308

[45] Date of Patent: Oct. 18, 1994

[54] CONNECTOR ASSEMBLY FOR A FLEXIBLE WIRING PLATE

[75] Inventors: Katsuaki Toba; Yutaka Noro; Takuya Inoue, all of Mie, Japan

[73] Assignee: Sumitomo Wiring Systems, Ltd., Yokkaichi, Japan

[21] Appl. No.: 953,801

[22] Filed: Sep. 30, 1992

[30] Foreign Application Priority Data

Oct. 31, 1991 [JP] Japan ..... 3-313263
Nov. 1, 1991 [JP] Japan ..... 3-098452[U]

[51] Int. Cl.[5] ..... H01R 9/07

[52] U.S. Cl. ..... 439/495; 439/422

[58] Field of Search ..... 439/492–499, 439/67, 77, 271, 278, 281, 283

[56] References Cited

U.S. PATENT DOCUMENTS 3,088,090 4/1963 Cole et al. ..... 439/495
3,090,028 5/1963 Hall et al. ..... 439/495
3,149,896 9/1964 Hall ..... 439/495
4,834,660 5/1989 Cotti ..... 439/67
4,934,947 6/1990 Brummans et al. ..... 439/77
4,948,378 8/1990 Hoshino ..... 439/271

FOREIGN PATENT DOCUMENTS 280486 8/1988 European Pat. Off. .

*Primary Examiner*—David L. Pirlot
*Attorney, Agent, or Firm*—Sughrue, Mion, Zinn, Macpeak & Seas

[57] ABSTRACT

A connector assembly for connecting a flexible wiring plate, having circuit conductors coated with insulator films on the two sides thereof, to a box-like connector housing. The connector housing includes a housing body and a lid body detachably secured to the housing body. The housing body is provided with an opening in one of the top and bottom walls. An elastic seal member is mounted around the opening. A part of the insulator film of the flexible wiring plate is removed in accordance with the opening so that end portions of the circuit conductors are exposed from the insulator film in opposition to the opening. Electrical terminals are disposed in the housing body so that elastic contacts of the terminals engage with the exposed end portions of the circuit conductors.

2 Claims, 13 Drawing Sheets

CONNECTOR ASSEMBLY FOR A FLEXIBLE WIRING PLATE

BACKGROUND OF THE INVENTION

1. Field of the Invention

This invention relates to a connector assembly for a flexible wiring plate to be used in, for example, a wire harness and the like for a motor vehicle and an OA device.

2. Statement of the Prior Art

A wire harness for a motor vehicle is generally required to be water-proof. In particular, it is important to water-proof a connecting portion of an electrical wire in a connector.

For convenience of explanation, prior coated electrical wire and a flexible wiring plate will be described below by referring to the drawings. FIGS. 17 and 18 are cross sectional views of a coated electrical wire 3 and a flexible wiring plate 13.

As shown in FIG. 17, in the case of a wire harness which connects the coated electrical wire 3 to a connector 4, an elastic seal member 5 covers an outer periphery of a portion of the wire 3 to be coupled to the connector 4 so that a gap between the wire 3 and connector 4 is sealed water-proof the coupling portion or the wire for the connector 4.

In the wire harness described above, the seal member 5 closely contacts with the entire periphery of the electrical wire 3 and thus water-proofs the coupling portion of the wire for the connector 4, since a cross section of the electrical wire 3 is formed substantially into a circle.

As shown in FIG. 18, however, in the case of a wire harness composed of a flexible wiring plate 13 such as flexible printed circuit (FPC) or the like, even if an elastic seal member 15 covers the outer periphery of the plate 13 to water-proof the connector coupling portion, it is impossible to water-proof the plate 13 on account of a lower adhesive force existing at the corner of the elastic seal member 15 so that water enters into the connector through the clearance to lower an electrical connecting reliability, since a cross section of the plate 13 is formed into a flat rectangular shape.

For example, Japanese Patent Public Disclosure No. 3-163771 (1991) discloses a construction in which a connector is coupled to an end of a flexible wiring plate such as a flexible flat cable (FFC), a FPC, or the like having circuit conductors covered with insulator films on two sides. In such a coupling construction, the insulator film on end portions of the flexible wiring plate is removed to expose the circuit conductor, the end portions are inserted into a wiring plate through insertion holes, and the exposed circuit conductors are connected with electrical terminals in a connector housing to make an electrical connection between the circuit conductors and the electrical terminals.

In the above connector coupling construction for a flexible wiring plate, however, water enters into the connector housing through the coupling portion and this results in a lowering of the electrical coupling reliability, since the wiring plate through-holes are not water-proofed.

SUMMARY OF THE INVENTION

An object of the present invention is to provide a connector assembly for a flexible wiring plate, in which a connector housing has a water-proofing function at a connecting portion of the flexible wiring plate.

In order to achieve the above object, a connector assembly connects a flexible wiring plate, having circuit conductors coated with insulator films on the two sides thereof, to a box-like connector housing. The connector housing includes a housing body and a lid body detachably secured to the housing body. The housing body is provided with an opening in one of top and bottom walls. An elastic seal member is mounted around the opening. A part of the insulator film of the flexible wiring plate is removed in accordance with the opening so that end portions of the circuit conductors are exposed from the insulator film in opposition to the opening. Electrical terminals are disposed in the housing body so that elastic contacts of the terminals engage with the exposed end portions of the circuit conductors.

It is preferable for the electrical terminals to be disposed in the housing body so that the elastic contacts project from the opening, and so that the lid body presses the flexible wiring plate onto the housing body to cause the elastic contacts to be contacted with the circuit conductors and to cause the elastic seal member to be pressed around a film-removed area on the flexible wiring plate.

The housing body may be provided with openings on both walls, the flexible wiring plates may be arranged on both walls of the housing body, and each of the lid bodies may be secured to the housing body.

It is also preferable for the opening in the housing body to be provided with wiring plate through insertion holes for passing the flexible wiring plate therethrough, for the flexible wiring plate to be provided with an attaching area including a non-wiring area and surrounding the end portions of the circuit conductors, for the end portions of the circuit conductors to be inserted into the wiring plate through holes and positioned within the seal member, and for the lid body to be secured to the housing body so that the seal member is closely contacted with the attaching area.

Electrical terminals may be pressed and connected to the end portions of the circuit conductors and the electrical terminals may be inserted into the wiring plated through insertion holes.

In the connector assembly for the flexible wiring plate in accordance with the present invention, the contacts of the electrical terminals in the connector contact with the exposed circuit conductors of the flexible wiring plate to form an electrical connection. Since the elastic seal member on the connector surrounds and presses the electrical connection portion and the film-removed area on the flexible wiring plate, the elastic seal member prevents water from entering into the connector.

Further, in accordance with the connector assembly for the flexible wiring plate of this invention, the elastic seal member is mounted on at least one of the housing body and the lid body while the attaching area is integrally formed around the end portions of the circuit conductors off the flexible wiring plate. The attaching area is clamped between the lid body and the housing body so that the seal member closely contacts with the attaching area. Consequently, the seal member contacts closely and uniformly with the entire outer periphery of the end portions of the circuit conductors to effect water-proofing.

DETAILED DESCRIPTION OF THE PREFERRED EMBODIMENTS

Figure 1:
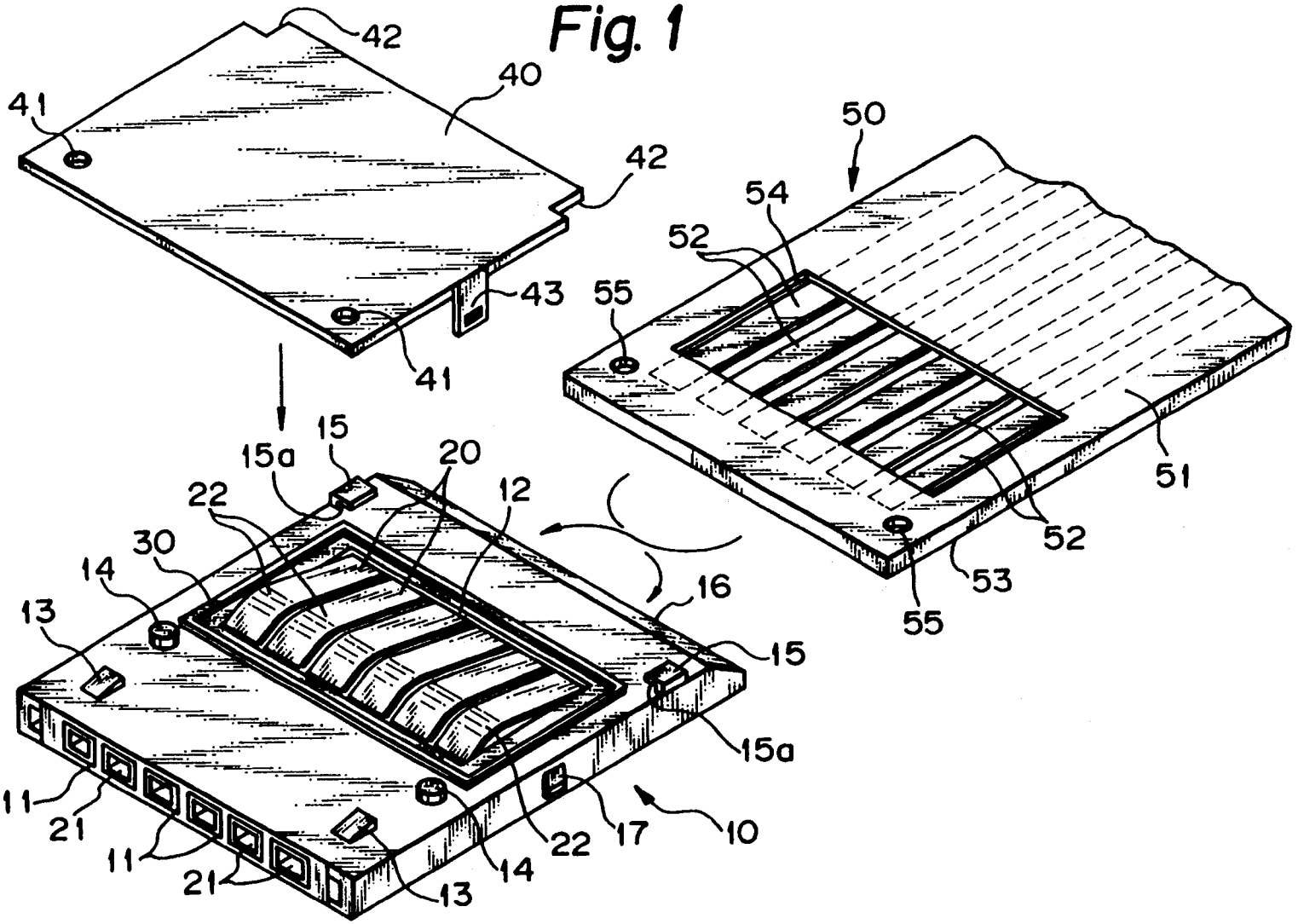
FIG. 1 is an exploded perspective view of a first embodiment of a connector assembly for a flexible wiring plate in accordance with the present invention.
Figure 2:
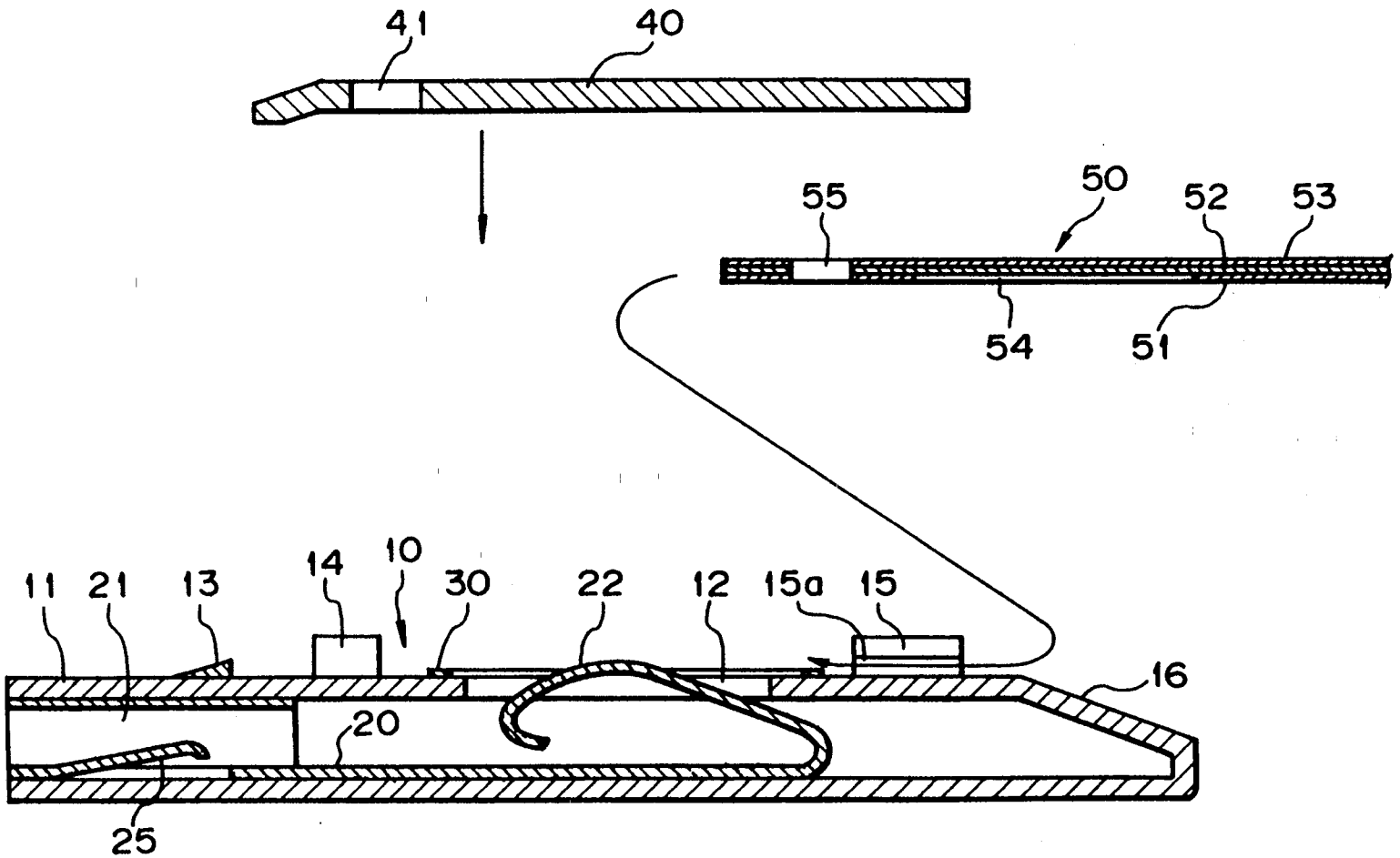
FIG. 2 is an exploded cross sectional view of the first embodiment of the connector assembly.
Figure 3:
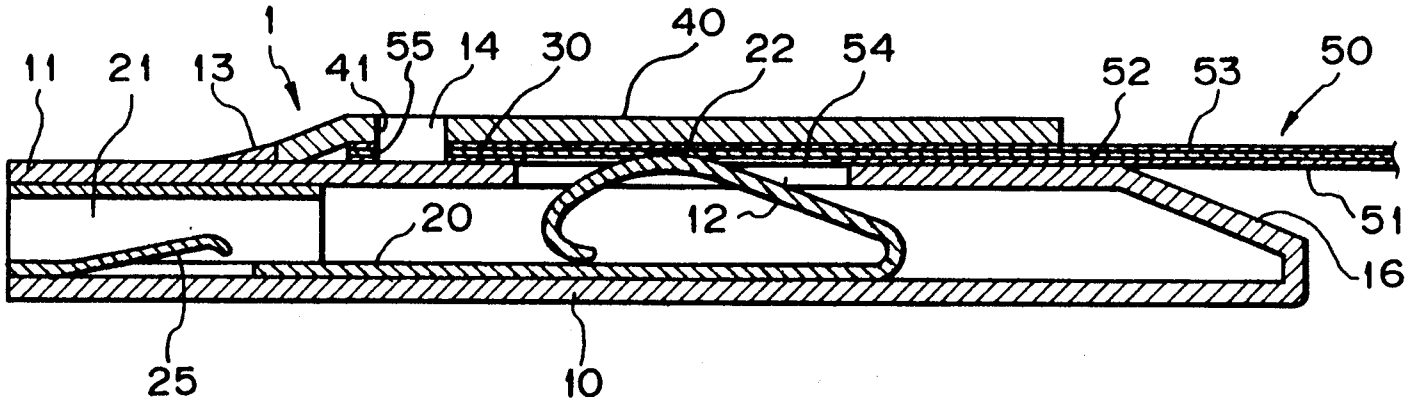
FIG. 3 is a longitudinal cross sectional view of the first embodiment of the connector assembly.

Referring now to FIGS. 1 through 16, embodiments of the connector assembly for the flexible wiring plate of the present invention will be explained below. FIGS. 1, 2 and 3 show a first embodiment of the connector assembly for the flexible wiring plate of the present invention. As shown in the drawings, a flexible wiring plate 50 such as an FFC, an FPC, or the like comprises an insulator film 51, a plurality of circuit conductors 52 forming a given circuit pattern on the insulator film 51, and another insulator film 53 covering over the circuit conductors. The flexible wiring plate 50 is provided with positioning holes 55 at the covers on the end portion thereof. A part of the lower insulator film 51 on the end portion of the plate 50 is removed to expose the circuit conductors 52.

On the other hand, a connector housing has a housing body 10 made of a resin and a lid body 40. The housing body 10 is formed into a box-like shape and has a plurality of terminal through insertion holes 11 provided in an end thereof. The housing body 10 is provided with a rectangular shaped opening 12 in a top wall in opposition to a film-removed area 54 in the flexible wiring plate 50. An elastic seal member 30 made of a rubber is attached through an adhesion around the opening 12 in the upper face of the housing body 10.

Stop protrusions 13 are formed integrally with the housing body 10 of one end at opposite sides while positioning protrusions 14 are formed between the stop protrusions 13 and the opening 12. Guides 15 are formed integrally with the housing body 10 on the other end at opposite sides thereof in order to guide the flexible wiring plate 50 along the upper face of the housing body 10. A slant face 16 is formed on the other end of the housing body 10 to smoothly guide the plate 50. Lock protrusions 17 are provided integrally with the housing body 10 on the opposite side faces (see FIG. 1).

Also, female electrical terminals 20 made of metal are disposed in the other end of the housing body 10. The electrical terminals 20 are provided along a width direction of the housing body 10 by the number corresponding to the number (e.g., 6) of the circuit conductors 52 of the flexible wiring plate 50. The electrical terminal 20 includes a terminal body 21 having a pipe-like shape and an elastic contact 22. The terminal body 21 is pressed into the terminal through hole 11 in the housing body 10. As shown in FIG. 2, the terminal body 21 is provided with a spring piece 22 which is adapted to elastically contact with a male terminal (not shown) to be inserted into the terminal body 21. The elastic contact 22 extends from the terminal body 21 into the housing body 10. A free end of the electrical terminal 20 is bent backward to form the elastic contact 22, which projects from the opening 12 (see FIG. 2).

The lid body 40 closes the opening 12 in the housing body 10 detachably and is provided with positioning hole 41 at corners on one end In opposition to the positioning protrusions 14. The lid body 40 is provided with cut-off portions 42 at corners on the other end to prevent an interferance with the guides 15. The lid body is also provided at opposite side faces with elastic hooks 43 adapted to elastically engage with the lock protrusions 17.

In order to couple the flexible wiring plate 50 to the connector housing 1, the film-removed area 54 on the flexible wiring plate 50 is directed downwardly, the plate 50 is inserted into guide grooves **15*a* of the guides 15 and led to the upper face of the housing body 10, and the positioning protrusions 14 on the housing body 10 enter into the positioning holes 55 in the plate 50. Consequently, the film-removed area 54 is disposed over the opening 12 and the exposed circuit conductors 52 in the film-removed area 54 contact with the contacts 22** of the electrical terminals, respectively.

Then, the lid body 40 is pressed on the housing body 10 while one end of the housing body 10 is engaging with the stop protrusions 13 on the body 10. Consequently, the positioning protrusions 14 on the body 10 enter into the positioning holes 41 in the lid body 40 while the hooks 43 engage with the lock protrusions 17. Thus, the flexible wiring plate 50 is pressed and secured to the housing body 10 by the lid body 40. This results in pressing the circuit conductors 52 onto the electrical terminals respectively to form the electrical connection therebetween. The seal member 30 presses the periphery of the film-removed area on the lower side of the plate 50.

As described above, the elastic seal member 30 on the housing body 10 presses the periphery of the film-removed area 54 on the flexible wiring plate 50 with the seal member 30 surrounding the electrical coupling portion of the circuit conductors 52 on the plate 50 and the contacts 22 of the electrical terminals. The seal member 30 prevents water from entering into the connector housing 1 and assures electrical connection reliability.

Since the slant face 16 is formed on the upper end of the housing body 10, the flexible wiring plate 50 is disposed along the slant face 16 and is not abruptly bent.

Figure 4:
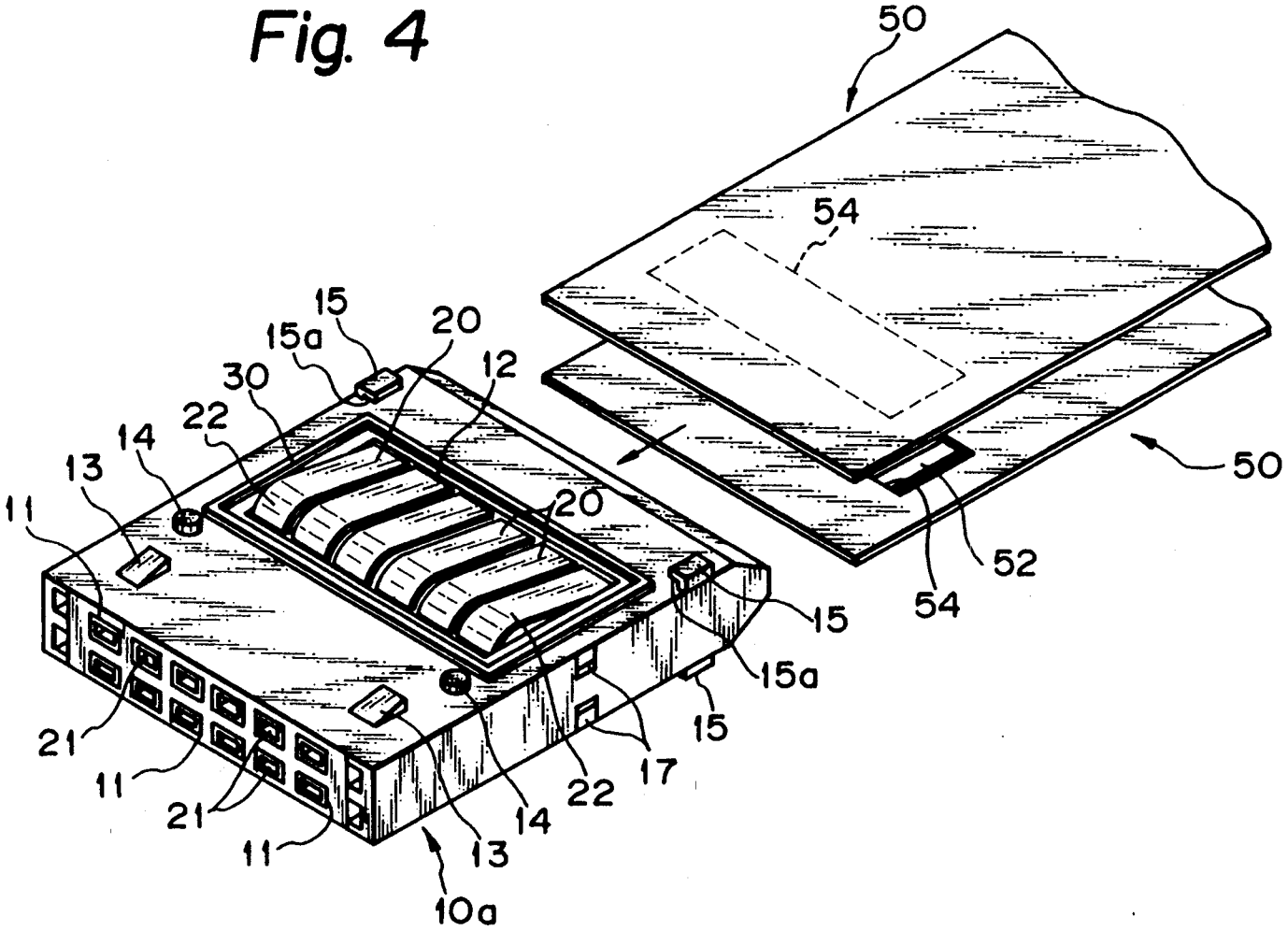
FIG. 4 is a perspective view of a second embodiment of the connector assembly of the present invention.

FIG. 4 shows a second embodiment of the present invention. When two flexible wiring plates 50 are to be used, it is preferable to provide a housing body 10*a* which includes two housing bodies 10 stacked on each other symmetrically. Each of the plates 50 is mounted on each of top and bottom walls on the housing body 10*a* having double constructions and secured to each of them by each of lid bodies (not shown).

Figure 5:
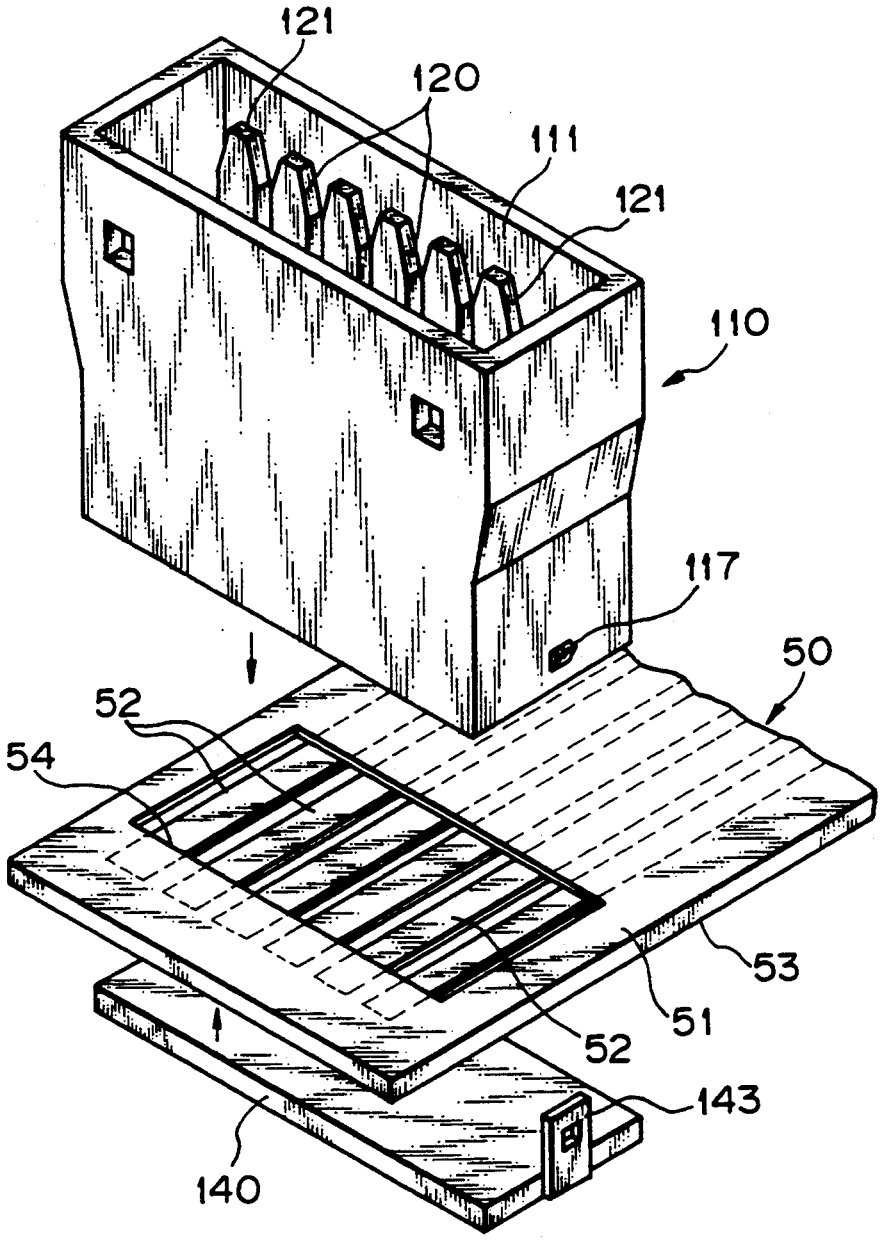
FIG. 5 is an exploded perspective view of a third embodiment of the connector assembly for the flexible wiring plate in accordance with the present invention.
Figure 6:
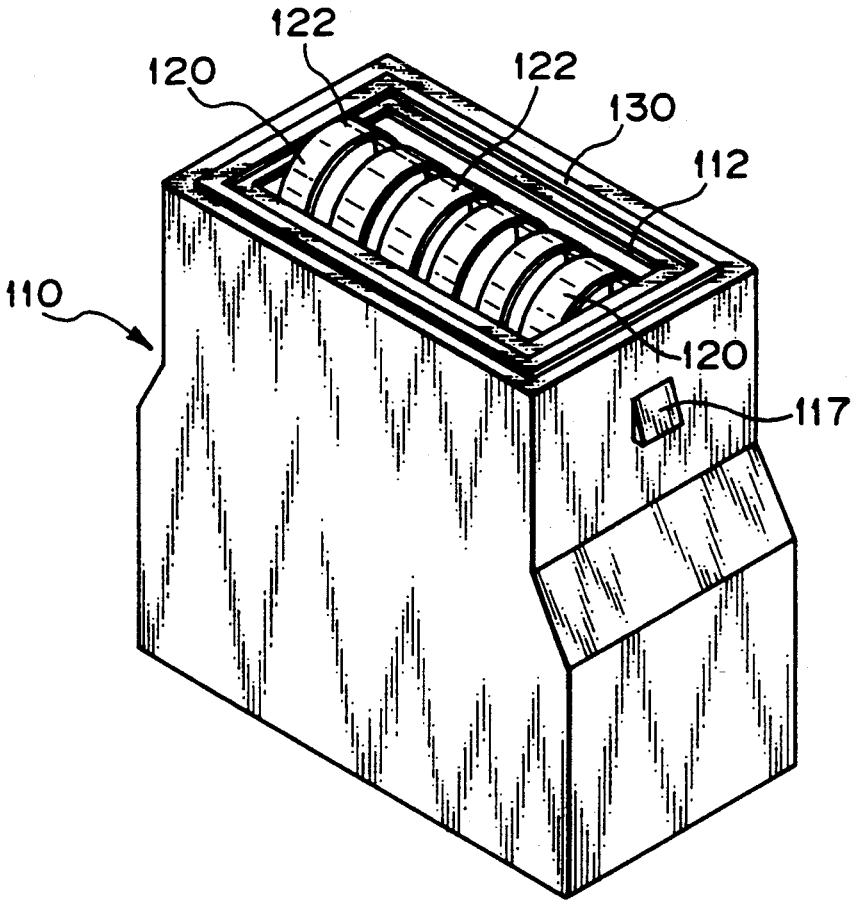
FIG. 6 is a perspective view of the reversed connector housing to be used in the third embodiment.

FIGS. 5 and 6 show a third embodiment of the present invention. As shown in the drawings, a box-like housing body 110 is provided with an opening 112 in the bottom wall. A seal member 130 made of a rubber is attached around the opening 112. The housing body 110 is also provided with terminal through insertion holes 111 in a top wall thereof.

A plurality of male electrical terminals 120 are disposed in the housing body 110 so that a terminal body 121 of the terminal 120 is disposed in the holes 111. Elastic contacts 122 formed by bending the terminals 120 backward project out of the opening 112.

The flexible wiring plate 50 is mounted on the lower face of the housing body 110 so that the film-removed area 54 on the plate 50 is faced to the opening 112. The lid body 140 is pressed onto the housing body 110 so that hooks 143 elastically engage with lock protrusions 117.

In this connector assembly for the flexible wiring plate, the elastic seal member 130 on the housing body 110 presses the periphery of the film-removed area 54 on the flexible wiring plate 50 by the lid body 140. The seal member 130 serves to water-proof the electrical connecting portions of the circuit conductors 52 and the electrical terminals 120 and to enhance the electrical connecting reliability.

Figure 7:
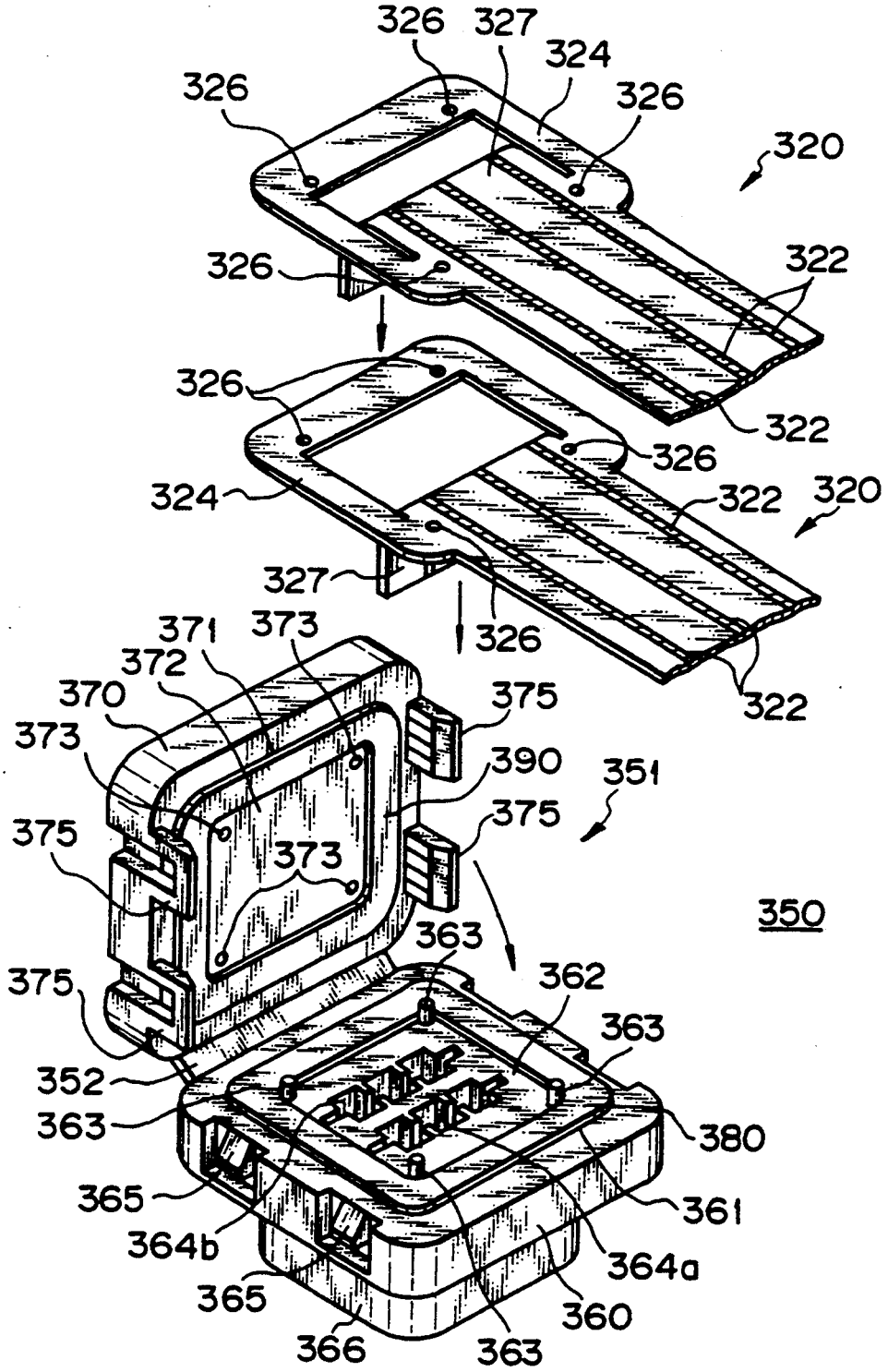
FIG. 7 is an exploded perspective view of a fourth embodiment of the connector assembly for the flexible wiring plate in accordance with the present invention.
Figure 8:
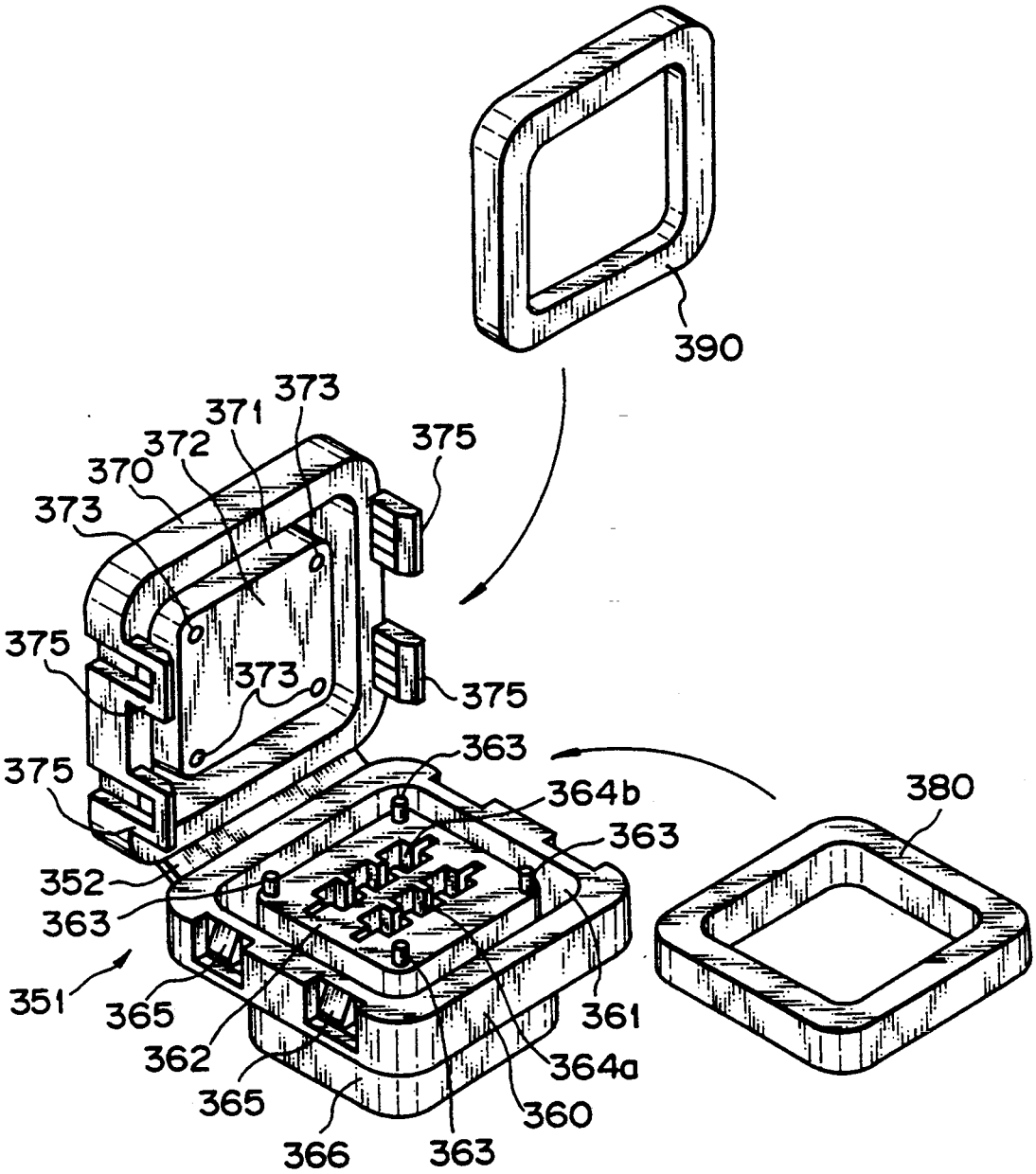
FIG. 8 is an exploded perspective view of the fourth embodiment of the connector assembly.

FIGS. 7 and 8 show a fourth embodiment of the connector assembly for the flexible wiring plate.

As shown in the drawings, a connector housing 351 made of a resin of a connector 350 comprises a housing body 360 and a lid body 370 detachably mounted on the upper face of the housing body 360. The lid body 370 is coupled to the housing body by a hinge 352. The housing body 360 is provided with a ring like seal-receiving recess 36]on the upper face thereof (see FIG. 8). Four corners on a center area encompassed by the recess 361 have positioning protrusions 363. First and second plate-through insertion holes 364*a* and 364*b* are formed in the center area to pass a flexible wiring plate 320. A ring-like rubber seal member 380 (see FIG. 8) formed in accordance with the recess 361 is fitted in the recess 361 with the seal member 380 projecting slightly away from the recess 361. In this case, the seal member 380 may be secured to the recess by an adhesion.

The housing body 360 is provided with two recesses on the upper opposite sides and with a lock protrusion 365 in each of the recesses. The housing body 360 is integrally provided with a pipe-like connector coupling portion 366 described below at the bottom side. The interior of the coupling portion 366 is in communication with the first and second plate through holes 364*a* and 364*b*.

On the other hand, the lid body 370 is provided with a ring-like seal receiving recess 371 in opposition to the seal receiving recess 361. Positioning holes 373 adapted to receive the positioning protrusions 363 are formed in four corners of the center area 372 encompassed by the recess 371. A ring-like rubber seal member 390 (see FIG. 8) formed in accordance with the recess 371 is fitted in the recess 371 with the seal member 390 projecting slightly from the recess 371. In this case, the seal member 390 may be secured to the recess 371 by an adhesion.

The lid body 370 is provided integrally at opposite sides with hooks 375 elastically engaging with the lock protrusions 365.

Figure 9:
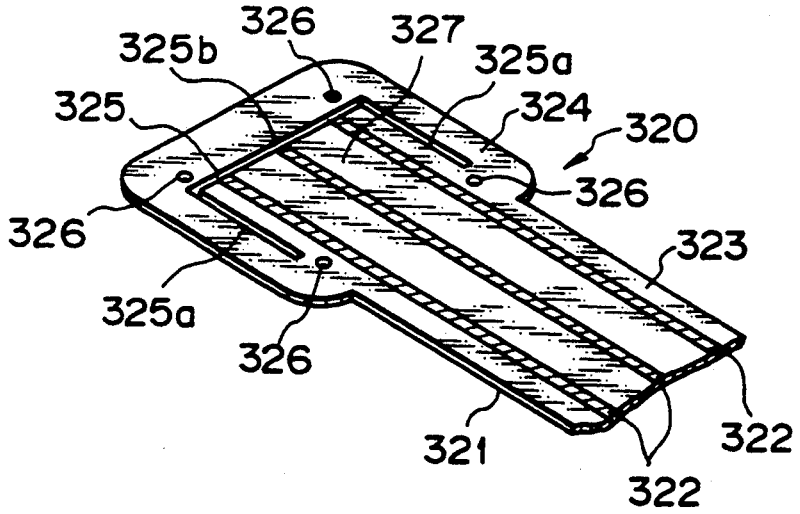
FIG. 9 is a perspective view of a flexible wiring plate to be used in the fourth embodiment.

As shown in FIG. 9, the flexible wiring plate 320 such as an FPC, an FFC, or the like has an insulator film 321, a plurality of circuit conductors 322 printed by a given circuit pattern on the film 321, and another insulator film 323 covering over the conductors 322. The flexible wiring plate 320 is provided with an attaching area 324 including a non-wiring area, which surrounds the circuit conductors 322 of an end of the plate 320.

The attaching area 324 is provided with a U-shaped shearing portion 325 including slits 325*a* formed along the opposite sides of the circuit conductors 322 and a slit 325*b* formed along the end of the circuit conductors 322 (see FIG. 9). The shearing portion 325 forms a tongue area 327 including the end portion of the circuit conductors 322. Positioning holes 326 are formed in four corners of the attaching area 324 in opposition to the positioning protrusions 363 on the housing body 360.

In order to couple the two flexible wiring plates 320 thus constructed to the connector 350, the insulator films 321 and 323 are removed From the tongue area 327 of one (lower one) of the plates 320 to expose the end portions of the circuit conductors 322 and after bending down the whole tongue area 327, the area 327 is inserted into the first plated through insertion hole 364*a* in the housing body 360. The positioning protrusions 363 on the housing body 360 are inserted into the positioning holes 326 and the attaching area 324 is mounted on the seal member 380 (see FIG. 7).

Then, the insulator films 321 and 323 are removed from the tongue area 327 of the other (upper one) of the plates 320 in the same manner as the one plate 320. The tongue area 327 is bent down and inserted into the second plate through hole 364*b* in the housing body 360. The positioning protrusions 363 are inserted into the positioning holes 326 and then the other plate 320 is stacked on the one plate 320. In this case, the tongue areas 327 inserted in the first and second plate through holes 364*a* and 364*b* are disposed in a connector coupling portion 366 described below.

Then, the positioning protrusions 363 are inserted into the positioning holes 373 in the lid body 370 by pressing the lid body 370 onto the housing body 360. The lid body 370 is secured to the housing body 360 by elastically engaging the hooks 375 with the lock protrusion 365. Consequently, the attaching area 324 on the flexible wiring plates 320 are clamped between the lid body 370 and the housing body 360 through the seal members 380 and 390.

Thus, it is possible to prevent water from entering into the connector through the clearance between the lid body 370 and the housing body 380, since the seal members 380 and 390 closely contact with the whole outer periphery of the end portions of the circuit conductors 322 including the attaching area 824.

Figure 10:
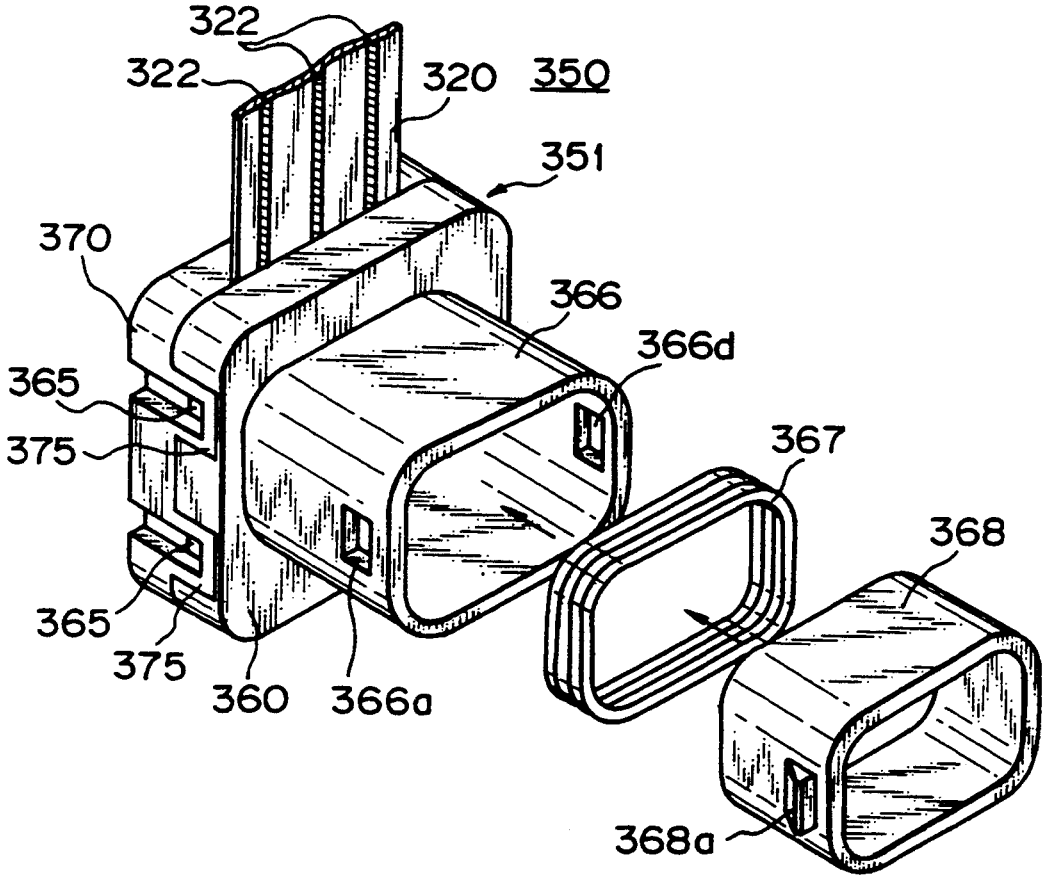
FIG. 10 is an exploded perspective view of the connector assembly in use of the fourth embodiment.
Figure 11:
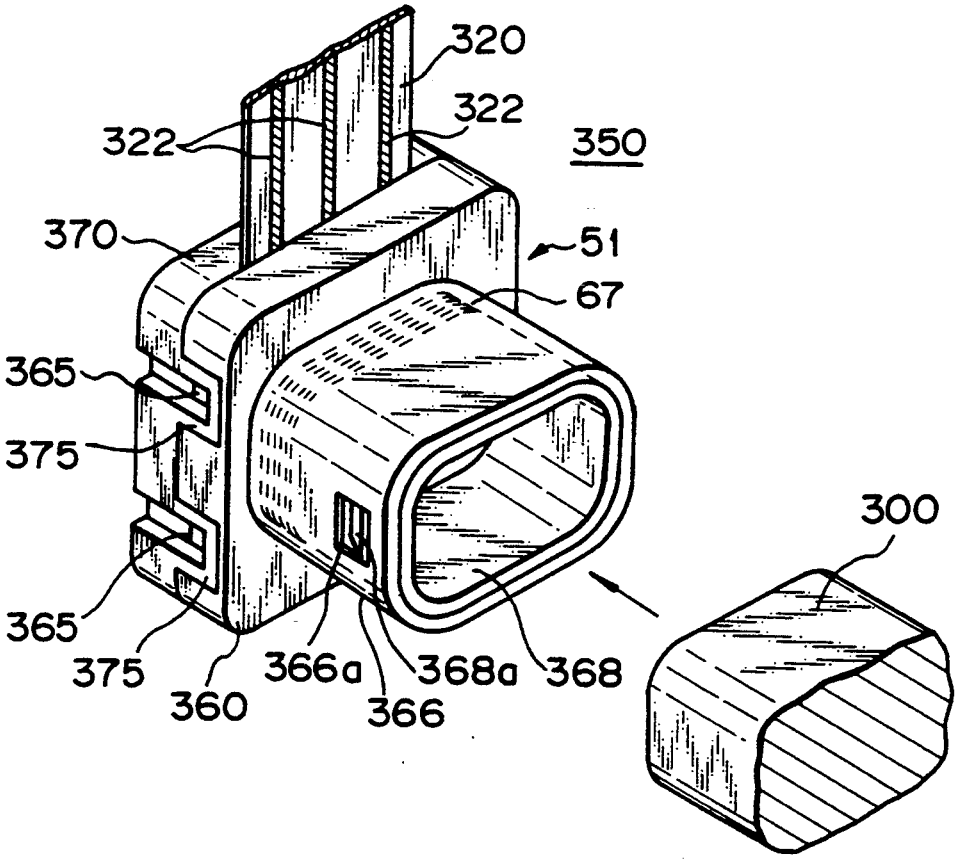
FIG. 11 is and exploded perspective view of the connector assembly in use of the fourth embodiment.

As shown in FIG. 10, in order to couple another connector to the connector 350 having the flexible wiring plate 320, a rubber ring 367 is inserted into the connector coupling portion 366 of the housing body 360 and a stop ring 368 is inserted into the portion 366 so that lock protrusions 368*a* on the stop ring 368 engage elastically with lock holes in the portion 366. This results in securing the rubber ring 367 in the portion 366.

Figure 12:
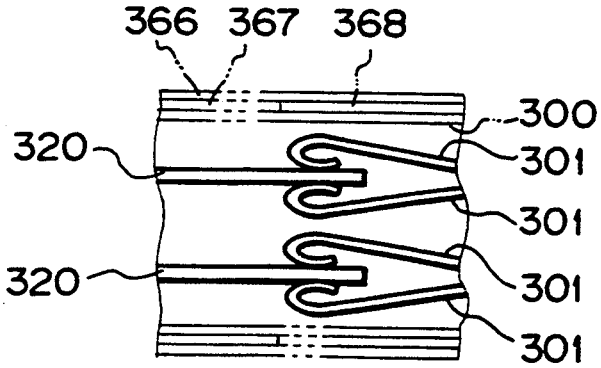
FIG. 12 is a partial side view of the connector assembly in use of the fourth embodiment.

Under this condition, another connector 300 is coupled to the connector coupling portion 366. In this case, as shown in FIG. 12, the connector 300 is provided with a pair of metal springs 301 in opposition to the circuit conductors 322. The tongue areas 327 are inserted between the pair of springs 301 so that the area 327 are clamped between the springs 301. Consequently, the springs 31 press the exposed circuit conductors 322 to make the electrical connection therebetween.

It is possible to prevent water from entering into the connector coupling portion 366 through the clearance between the connector 300 and the portion 366 by the rubber ring 367 fitted in the portion 366.

Figure 13:
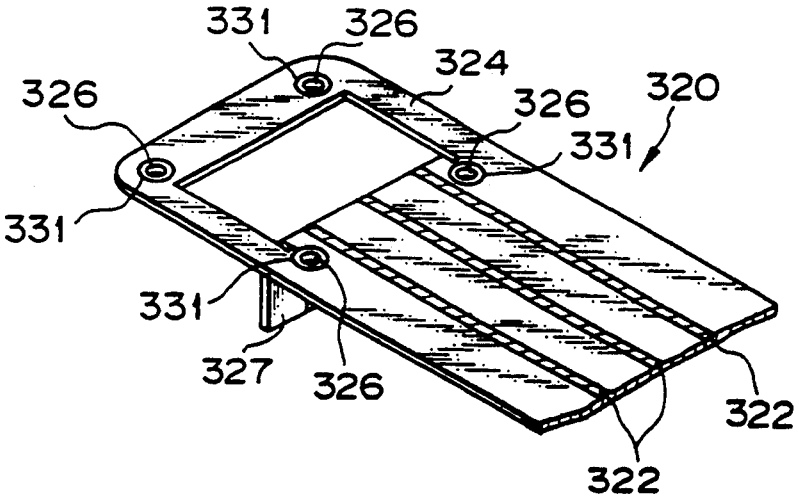
FIG. 13 is a perspective view of an alternative of the wiring plate to be used in the fourth embodiment.

As shown in FIG. 13, it is possible to prevent the periphery of the positioning holes 326 in the flexible wiring plate 320 from being broken by providing the holes 326 with a ring-like reinforcing member 381 therearound. Also as shown In FIG. 13, the non-wiring area for forming the attaching area 324 is not limited to the outer periphery on the end portion of the flexible wiring plate 320, but may be formed along the opposite sides of the plate 320.

Figure 14:
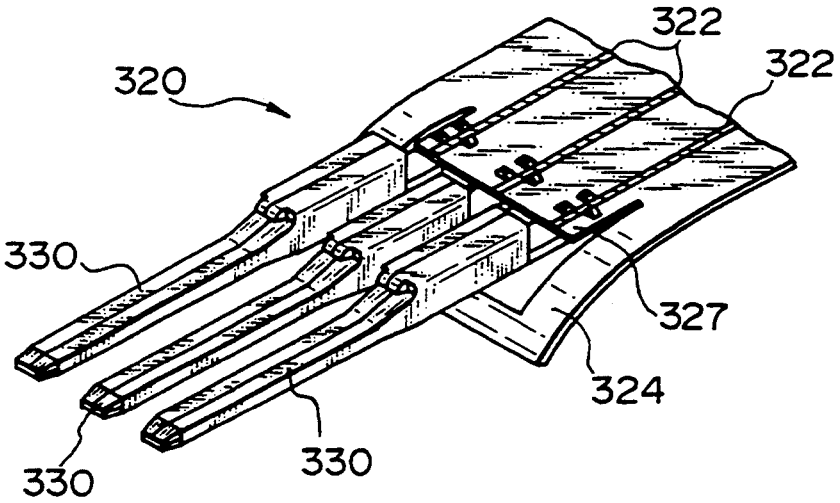
FIG. 14 is a perspective view of another alternative of the wiring plate to be used in the connector assembly.

As shown in FIG. 14, it is possible to attach the plate 320 with electrical terminals 330 to the connector housing 351 by pressing the electrical terminals 330 onto the tongue area 327 in correspondence to the respective circuit conductors 322 and by inserting the electrical terminals 330 into enlarged portion of the plate through holes 364*a* and 364*b* in the housing body 360.

In the case that the electrical terminal 330 is not pressed onto the flexible wiring plate 320 in the same manner as the above fourth embodiment, it is not necessary to provide the first and second plate-through holes 364*a* and 364*b* with the enlarged portions but to merely form them into slits.

Figure 15:
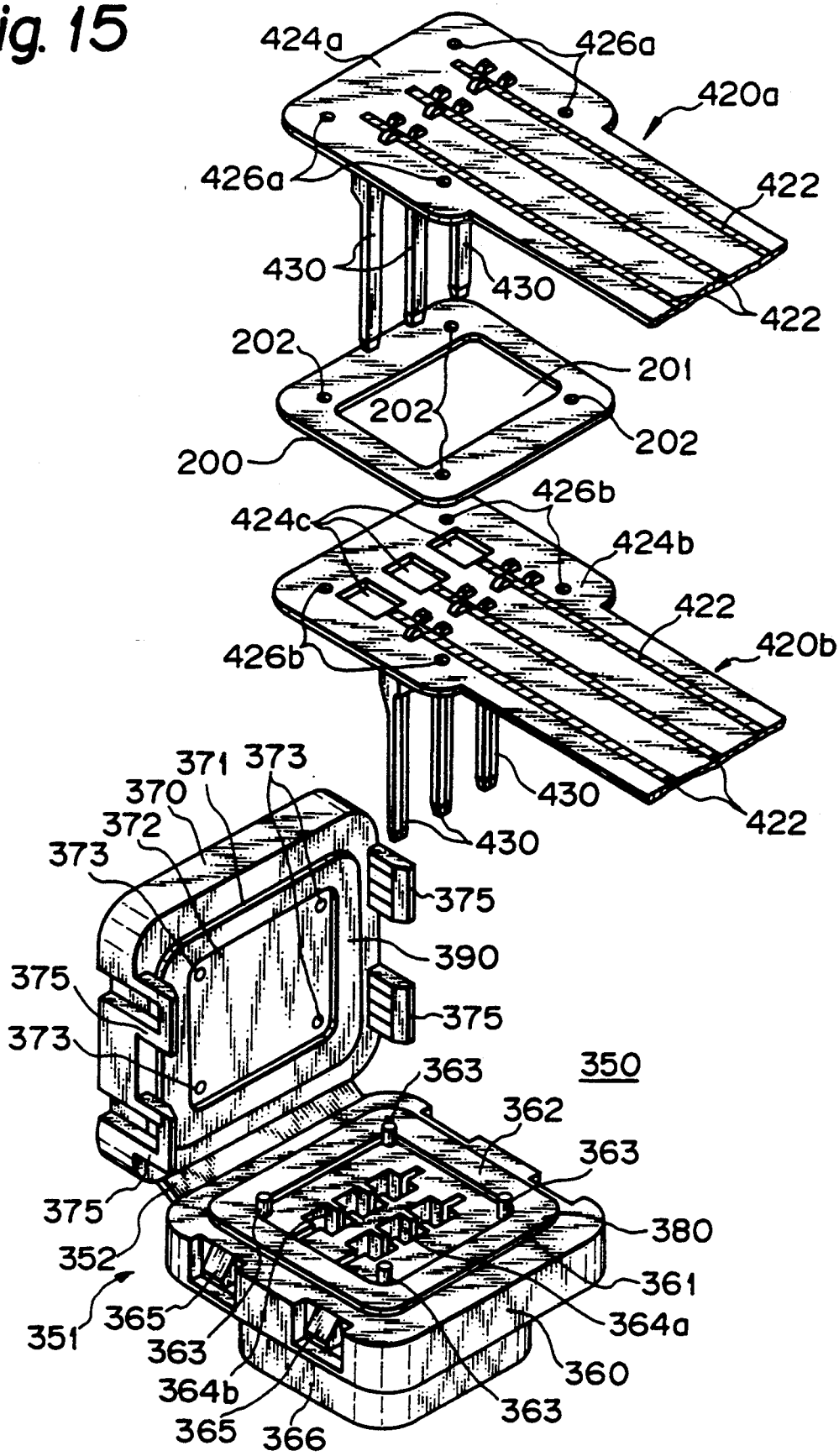
FIG. 15 is an exploded perspective view of a fifth embodiment of the connector assembly for the flexible wiring plate.
Figure 16:
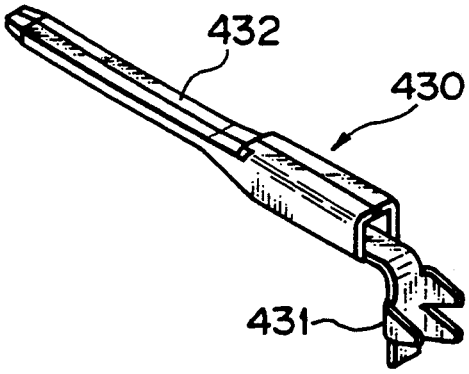
FIG. 16 is a perspective view of an electrical terminal to be used in the fifth embodiment.
Figure 17:
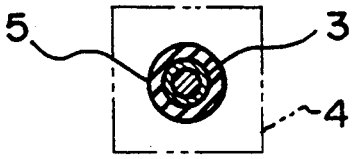
Fig. 17 PRIOR ART
FIG. 17 is a cross sectional view of a prior wire harness.
Figure 18:
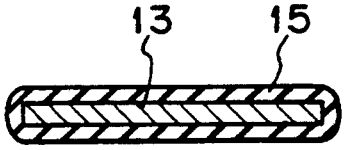
Fig. 18 PRIOR ART
FIG. 18 is across sectional view of a prior flat wire harness.

FIG. 15 shows a fifth embodiment of the connector assembly for the flexible wiring plate in accordance with the present invention. FIG. 16 is a perspective view of an electrical terminal 430 to be used in the fifth embodiment. As shown in the drawings, flexible wiring plates 420*a* and 420*b* such as the FPC, FFC or the like is provided with attaching areas 424*a* and 424*b* encompassing the end portion of circuit conductors 422 and including a non-wiring area therearound. Positioning holes 426*a* and 426*b* are formed in the four corners on the attaching areas 424*a* and 424*b*. The attaching area 424*b* on the lower plate 420*b* is provided with terminal through insertion holes 424*c* extending to the end portions of the circuit conductors 422.

On the other hand, the electrical terminals 430 are formed into a L-shape by bending a press contact 431 by an angle of 90 degrees relative to a terminal body 432. The press contacts 431 are pressed onto the end portions of the upper plate 420*a* with the terminal body 432 of the electrical terminal 430 being directed down. Similarly, the electrical terminal 430 is pressed onto the vicinity of the terminal through holes 424 of the circuit conductors 422 of the lower plate 420*b*.

The flexible wiring plates 420*a* and 420*b* are attached to the housing body 460 by inserting the terminal body 431 of the electrical terminal 430 pressed on the lower plate 420*b* into the enlarged portion of the first plate through hole 364*a* in the housing body 460 and inserting the positioning protrusion 463 into the positioning hole 426*b*.

Then, an insulator rubber film 200 having an opening at the center and positioning holes 202 at the four corners is mounted on the attaching area 424*b* on the lower flexible wiring plate 420*b* so that the positioning protrusions 363 are inserted into the positioning holes 202.

The electrical terminals 430 pressed on the upper flexible wiring plate 420*a* are inserted into the opening 201 in the insulator rubber film 200, the terminal through insertion holes 424*c* in the lower flexible wiring plate 420*b*, and the enlarged portion in the second plate through insertion hole 364*b* in the housing body 360, while the positioning protrusions 363 are inserted into the positioning holes 426*a*.

Finally, the lid body 370 is pushed down on the housing body 360 so that the hooks 375 engage with the lock protrusions 365. The seal members 390 and 380 and the insulator rubber film 200 contact closely around the end portion of the circuit conductors including the attaching areas 424*a* and 424*b* on the flexible wiring plates 420*a* and 420*b*. This results in water-proofing of the plate coupling portion and preventing the water from entering into the connector.

Although the above embodiments utilize two flexible wiring plates 320, 420*a*, and 420*b*, the connector assembly of the present invention can utilize one or more than three plates.

The seal members 380 and 390 may be attached to both of the housing body 360 and the lid body 370, or either one of them.

In the connector assembly for the flexible wiring plate as described above, the electrical connection can be obtained by the contact between the exposed circuit conductors of the plate and the contacts of the electrical terminals in the connector. The elastic seal member on the connector presses around the film-removed area on the plate. Consequently, the elastic seal member can water-proof the coupling portion between the circuit conductors and the electrical terminals and this improves the electrical connection reliability.

Further, the elastic seal member is mounted on at least one of the housing body and the lid body, the attaching area Is formed integrally with the outer periphery of the end portion of the plate so that the attaching area surrounds the end portions of the circuit conductors, and the attaching area is clamped between the lid body and the housing body so that they contact closely with the attaching area. Consequently, the seal member contacts closely and uniformly with the whole outer periphery of the end portions of the circuit conductors and can surely water-proof the plate connecting portion to prevent water from entering into the connector.

What is claimed is:

1. In a connector assembly for connecting a flexible wiring plate, having circuit conductors coated with insulator films on the two sides thereof, to a box-like connector housing;

said connector assembly for the flexible wiring plate being characterized in that:

said connector housing includes a housing body, including top and bottom walls, and a lid body detachably secured to said housing body;

said housing body is provided with an opening in one of said top and bottom walls thereof;

an elastic seal member is mounted around said opening;

a part of said insulator film of said flexible wiring plate is removed in accordance with said opening so that end portions of said circuit conductors are exposed from said insulator film in opposition to said opening; and electrical terminals having elastic contacts are disposed in said housing body so that said elastic contacts of said terminals engage with said exposed end portions of said circuit conductors;

wherein said opening in said housing body is provided with wiring plate through-holes for passing said flexible wiring plate therethrough, wherein said flexible wiring plate is provided with an attaching area which surrounds said end portions of said circuit conductors, said attaching area comprising a U-shaped shearing portion including side slits formed along opposite sides of said circuit conductors and an end slit formed along an end of said circuit conductors, said shearing portion forming a tongue area, which includes said end portions of said circuit conductors, and a non-wiring area spaced apart from said tongue area, wherein said end portions of said circuit conductors are inserted into said wiring plate through-holes and positioned within said seal member, and wherein said lid body is secured to said housing body so that said seal member is closely contacted with said attaching area.

2. A connector assembly for the flexible wiring plate according to claim 1, wherein electrical terminals are pressed and fixedly connected to said end portions of said circuit conductors and wherein said electrical terminals are inserted into said wiring plate through-holes.

* * * * *